US008066547B1

(12) United States Patent
Schuh et al.

(10) Patent No.: US 8,066,547 B1
(45) Date of Patent: Nov. 29, 2011

(54) BRIDGE ROW TOOL

(75) Inventors: Gregory W. Schuh, Camarillo, CA (US); Tracy Lytle, Camarillo, CA (US)

(73) Assignee: Veeco Instruments Inc., Woodbury, NY (US)

( * ) Notice: Subject to any disclaimer, the term of this patent is extended or adjusted under 35 U.S.C. 154(b) by 0 days.

(21) Appl. No.: 10/993,017

(22) Filed: Nov. 18, 2004

Related U.S. Application Data

(60) Provisional application No. 60/523,238, filed on Nov. 18, 2003.

(51) Int. Cl.
*B24B 49/00* (2006.01)

(52) U.S. Cl. ..... 451/5; 451/1

(58) Field of Classification Search ..... 451/5, 41, 451/11, 1, 28; 29/603.1, 603.15, 603.16, 29/593

See application file for complete search history.

(56) References Cited

U.S. PATENT DOCUMENTS 3,613,228 A 10/1971 Cook et al.
4,333,229 A 6/1982 Ellenberger
4,376,337 A 3/1983 Kobayasi et al.
4,769,899 A 9/1988 Yasuda et al.
5,117,589 A 6/1992 Bischoff et al.
5,329,689 A 7/1994 Azuma et al.
5,454,158 A 10/1995 Fontana et al.
5,525,091 A * 6/1996 Lam et al. ..... 451/1
5,588,199 A 12/1996 Krounbi et al.
5,607,340 A 3/1997 Lackey et al.
5,620,356 A * 4/1997 Lackey et al. ..... 451/5
5,735,036 A 4/1998 Barr et al.
6,093,083 A 7/2000 Lackey
6,261,165 B1 7/2001 Lackey et al.
6,315,636 B1 * 11/2001 Yanagida et al. ..... 451/11
6,321,440 B1 11/2001 Crawforth et al.
6,360,428 B1 3/2002 Sundaram et al.
6,599,170 B2 * 7/2003 Sone et al. ..... 451/5
6,775,098 B2 8/2004 Ostrowski et al.

* cited by examiner

*Primary Examiner* — Dung Van Nguyen
(74) *Attorney, Agent, or Firm* — Koppel, Patrick, Heybl & Philpott

(57) ABSTRACT

A lapping row tool comprising a plurality of bending nodes having a space between adjacent ones of said nodes and each of which has an end surface to manipulate a row of magnetic heads during lapping. A bridge extends along the end surfaces of the bending nodes and across the space between the adjacent bending nodes. The bridge provides a surface for holding the row of magnetic heads that prevents the flexing of the row into the space between the bending nodes during lapping while allowing the bending nodes to manipulate the row during lapping.

25 Claims, 10 Drawing Sheets

120

BRIDGE ROW TOOL

This application claims the benefit of provisional application Ser. No. 60/523,238 to Schuh et al., which was filed on Nov. 18, 2003.

BACKGROUND OF THE INVENTION

1. Field of the Invention

This invention relates to lapping systems for hard drive magnetic heads, and more particularly to row tools used in lapping systems.

2. Description of the Related Art

Magnetic heads (also called sliders) for hard drives read data from the media (platter/disk) by sensing changes in magnetic field strength emanating from magnetic grains in the media. A writer is also included in the head that generates a magnetic field orienting the grains based on whether a one or zero is stored. The data is stored magnetically by alternating magnetic fields created by the writer as the gap (space between the poles) of the electromagnetic element glides (or slides) over the surface of the disk. The data is stored on the disk in a circular pattern with data tracks spaced as close as ten millionths of an inch apart, with as many as one hundred thousand tracks per inch. The data is stored by the writer in a track as individual "bits" at as many as five hundred thousand bits per inch, or as close together as two millionths of an inch. The data can then be read back by the reader-part of the head which contains a "magneto-resistive" material between two shields, with the magneto-resistive material changing resistance based on the magnetic orientation of a magnetic field.

Magnetic heads go through a number of processes before being lapped (or polished) to obtain the proper magnetic performance. The magnetic heads are typically deposited in rows on a wafer using fabrication and deposition techniques similar to those developed in the semiconductor industry. The wafer is then sliced into individual rows or a block of several rows of magnetic heads that are then bonded onto a row tool for the lapping operation. The row tool is then mounted in a lapping system/machine that laps the row of magnetic heads. Depending on the size of the heads and the length of the rows, there may be from 30 to 80 heads that are lapped simultaneously.

This lapping procedure removes material from the lower surface of the row and is one of the final procedures in manufacturing the magnetic heads/sliders. Using conventional lapping processes and row tools there was little to no control over the lapping of individual heads or groups of heads. As a result, all heads in the row had to meet the end performance target at the same time. Often times, however, the individual heads exhibit different performance characteristics at the end of lapping, and some of the heads characteristics are outside the acceptable range. These unacceptable heads are typically discarded which leads to waste that can increase the overall cost of the acceptable heads.

More recently, row tools have been developed that have control points that are designed to influence the row on the row tool to allow the lapping process to define the primary shape of the row of sliders. This also allows some control over the primary surface finish, device dimensions (distance from reading and writing elements to machined surface), and the shape and condition of the exposed surfaces. See U.S. Pat. Nos. 5,607,340 and 5,620,356 to Lackey et al.

FIG. 1 shows a more recent row tool 10 having a row of sliders 12 bonded on its lapping surface 14 that provides limited control over the lapping of the magnetic heads. Tool 10 includes seven "nodes" 16, or control points, and a lapping surface 14 to which a row of magnetic heads 12 can be mounted. The nodes 16 allow the lapping machine to alter the lapping surface 14 and thereby control the shape of row 12 mounted on lapping surface 14. The lapping machine manipulates the nodes by applying bending force (positive or negative force) at each node 16, which essentially bends the lapping surface 14. This bending provides the control of the shape of the lapping surface 14 row during the lapping which in turn controls the shape of row 12.

One of the primary disadvantages of row tool 10 is that each of the rows can have between approximately and 80 magnetic heads so that each of the seven control nodes 16 bends the lapping surface 14 under several magnetic heads. Force interpolation is required at nodes 16 to "estimate" a best fit line between the heads on the row for which a discrete bending node is not available. This results in a less than optimum dimensional control for the population of heads on a row.

A relatively recent advancement in row tool technology has been the development of row tools with bending nodes along the entire row of heads. This increases the number of control nodes from the previously conventional seven, to forty-eight (48) or more. For a row with forty-eight heads, each head can have its own bending node; referred to as Single Slider Level Lapping Technology (SLLT). FIG. 2 shows one embodiment of a SLLT row tool 20 having forty-eight nodes 22, each of which has a top surface, with the node top surfaces together serving as lapping surface 24. A row 26 of heads is arranged on lapping surface 24, preferably with one of the heads in row 26 over a respective one of nodes 22. Applying the required bending force (positive or negative force) at each head location in row 26 results in much better control over dimensional features of the full population of devices on row 26.

The row tool 20, however, has a lapping surface that is interrupted along its length by the spaces between the bending nodes 22. FIG. 3 shows row 26 mounted to nodes 22 with a respective head 28 arranged over a respective one of nodes 22. During lapping, the pressure of the lapping surface can cause row 26 to flex into the space between nodes 22. After the pressure is removed, row 26 flexes back such that the resulting lapped row 26 can have bumps 30 or other imperfections on its lapped surface.

Another disadvantage is that the bonding surface of the row tool can be ductile. As a result, the bonding surface can be altered such that the slider dimensions and geometry are undesirably changed. This can easily happen during the lapping process without detection so that many defective sliders will be fabricated. These defective sliders may not be usable, which leads to waste and increases costs.

SUMMARY OF THE INVENTION

One embodiment of a lapping row tool according to the present invention comprises a plurality of bending nodes having a space between adjacent ones of the nodes and each of which has an end surface to manipulate a row of magnetic heads during lapping. A bridge extends along the end surfaces of the bending nodes and across the space between the adjacent bending nodes. The bridge provides a surface for holding the row of magnetic heads that prevents the flexing of the row into the space between the bending nodes during lapping while allowing the bending nodes to manipulate the row during lapping.

Another embodiment of a lapping row tool according to the present invention comprises a plurality of bending nodes to manipulate a row of magnetic heads during lapping. An uninterrupted surface holds the row of magnetic heads with the bending nodes engaging the uninterrupted surface and manipulating the magnetic heads during lapping by applying a force to the uninterrupted surface to alter the orientation of the surface and in turn, the row.

One embodiment of a lapping system control head according to the present invention comprises a mounting post for mounting into a lapping machine. A row tool is mounted within the control head with the row tool including a plurality of bending nodes with a bridge on the bending nodes providing a surface for holding a row of magnetic heads. A control voice coil manipulates the bending nodes with the bending nodes engaging the bridge to manipulate the shape of the surface of the bridge. This in turn controls the shape of the row on the surface to control lapping of the heads in said row.

These and other further features and advantages of the invention would be apparent to those skilled in the art from the following detailed description, together with the accompanying drawings, in which:

DETAILED DESCRIPTION OF THE INVENTION

Figure 1:
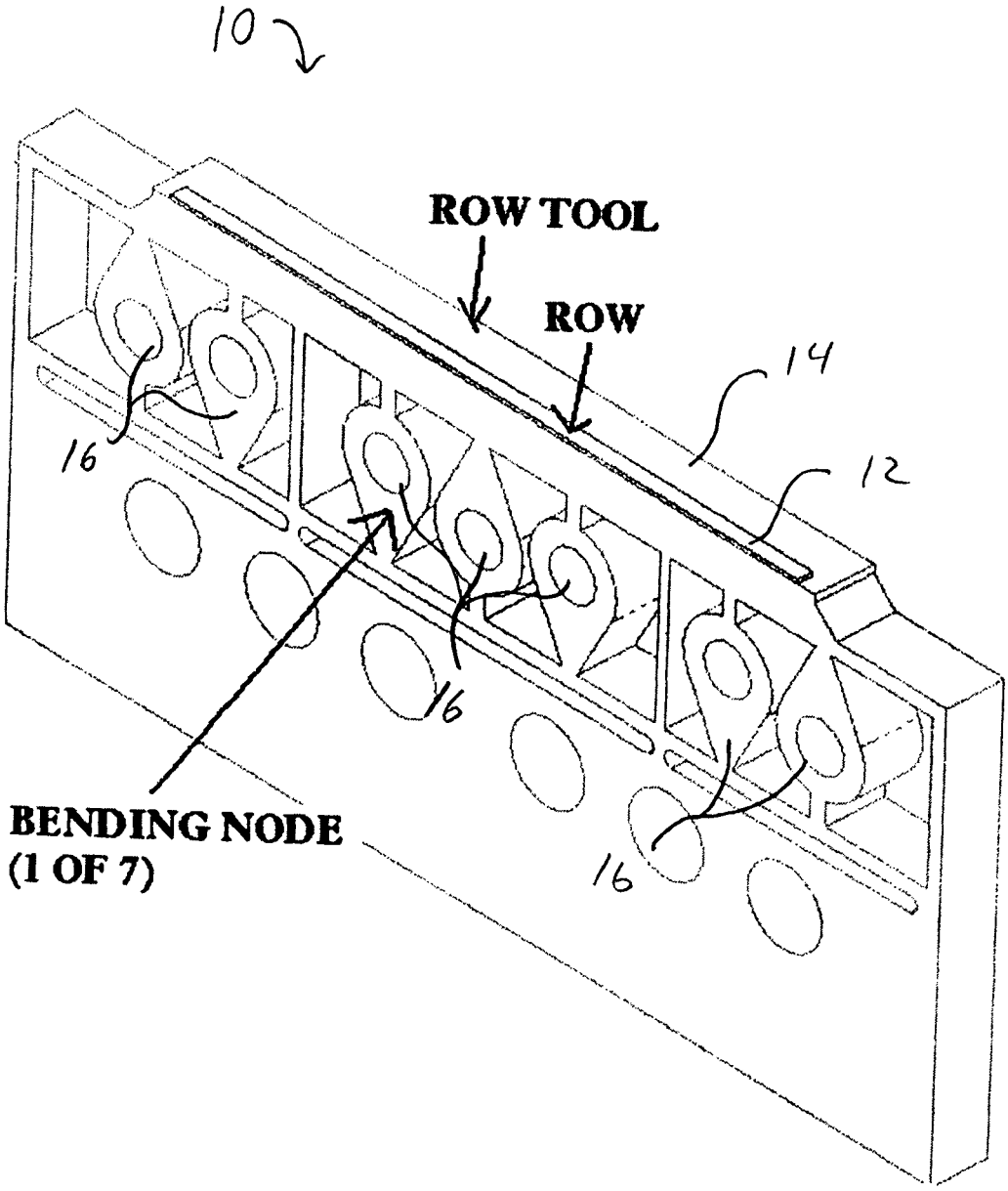
FIG. 1 PRIOR ART
FIG. 1 is a perspective view of a conventional seven node row tool.
Figure 2:
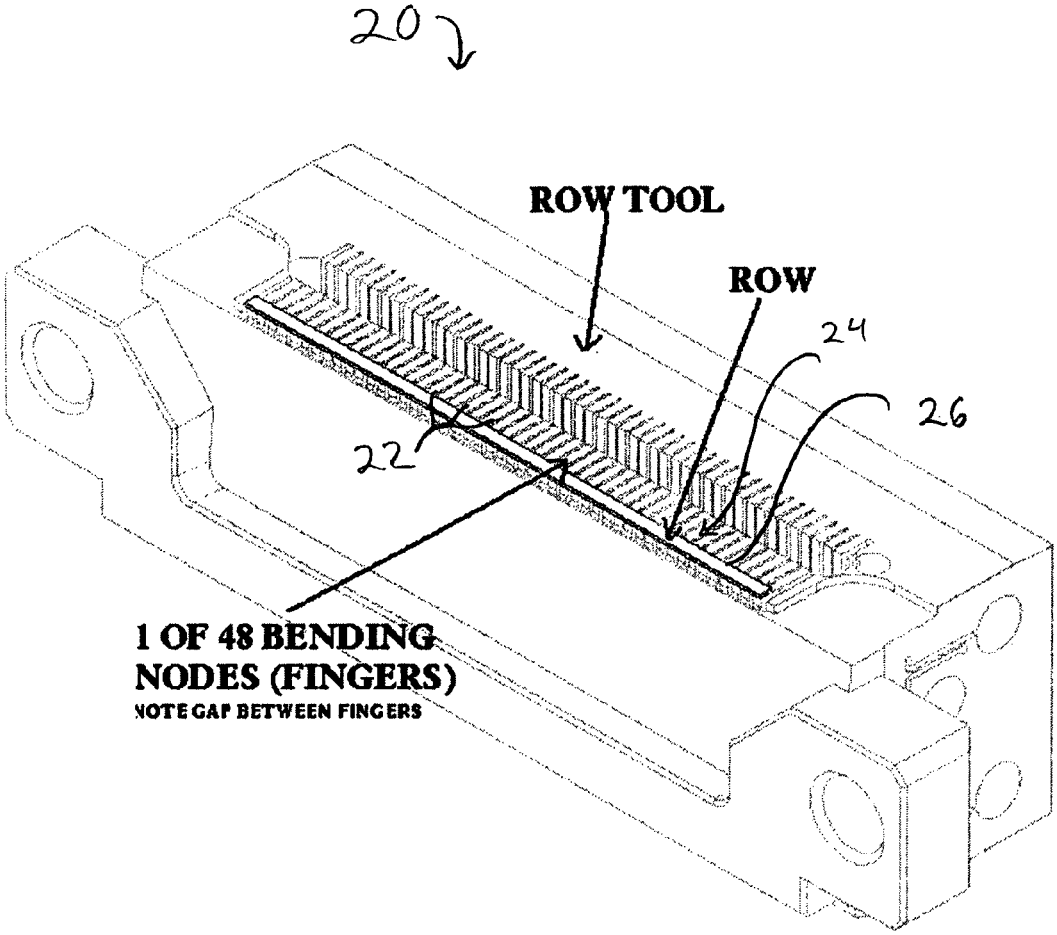
FIG. 2 PRIOR ART
FIG. 2 is a perspective view of a conventional SLLT 48 point row tool.
Figure 3:
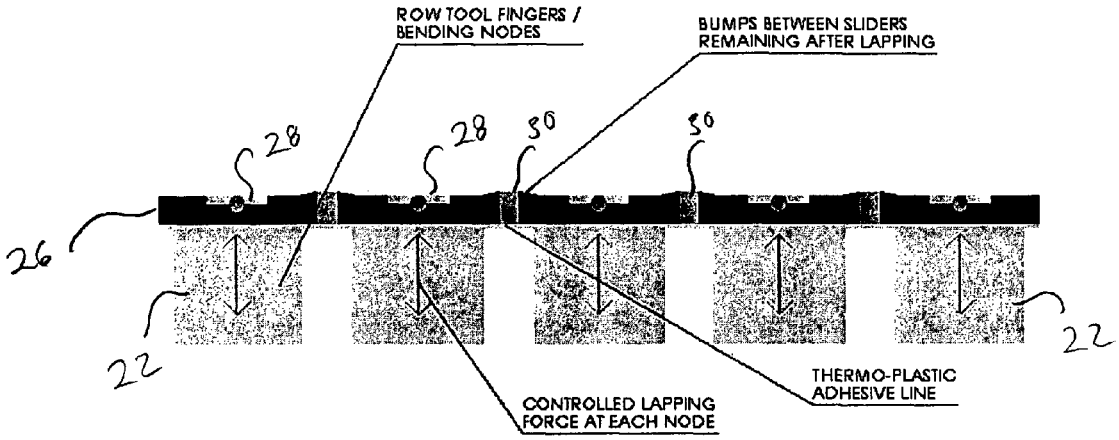
FIG. 3 PRIOR ART
FIG. 3 is a sectional view of a row mounted to a conventional row tool showing bumps that can form on a row the lapping process.
Figure 4:
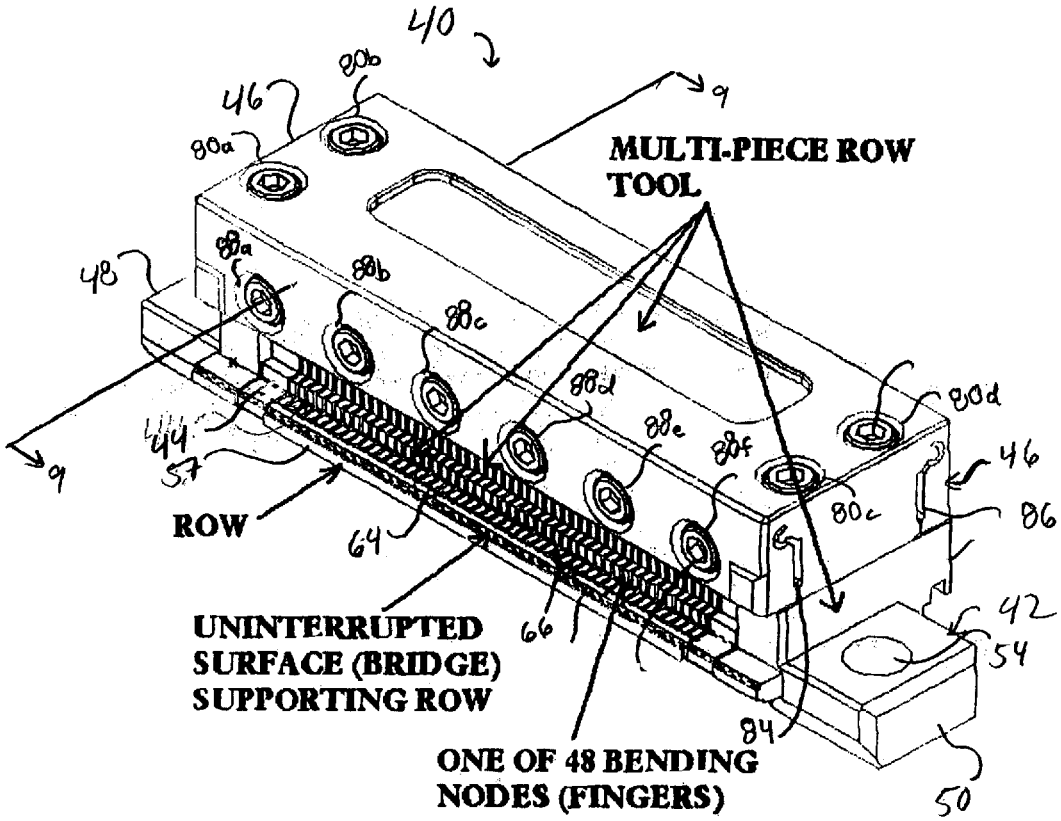
FIG. 4 is a perspective view of one embodiment of a row tool according to the present invention.
Figure 5:
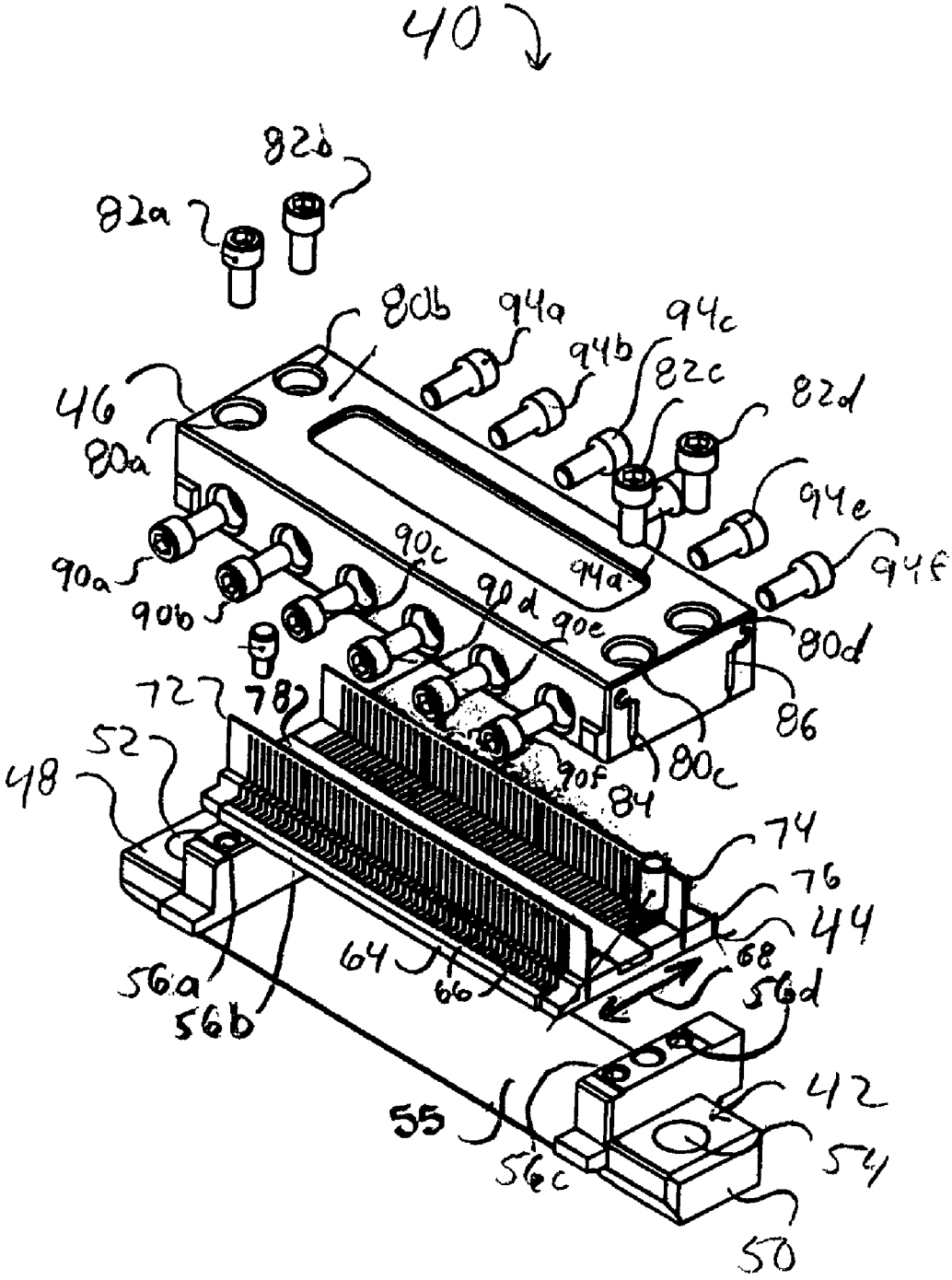
FIG. 5 is a perspective exploded view of the row tool in FIG. 4.
Figure 6:
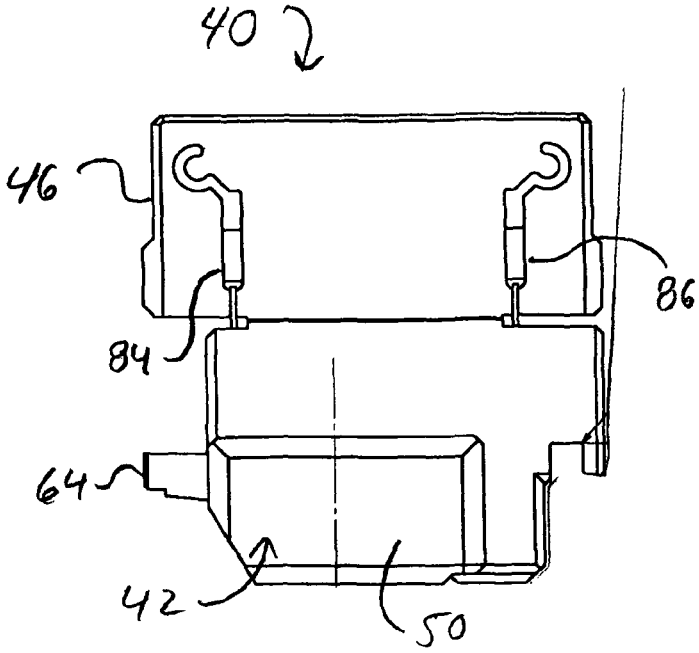
FIG. 6 is an end elevation view of the row tool in FIG. 4.
Figure 7:
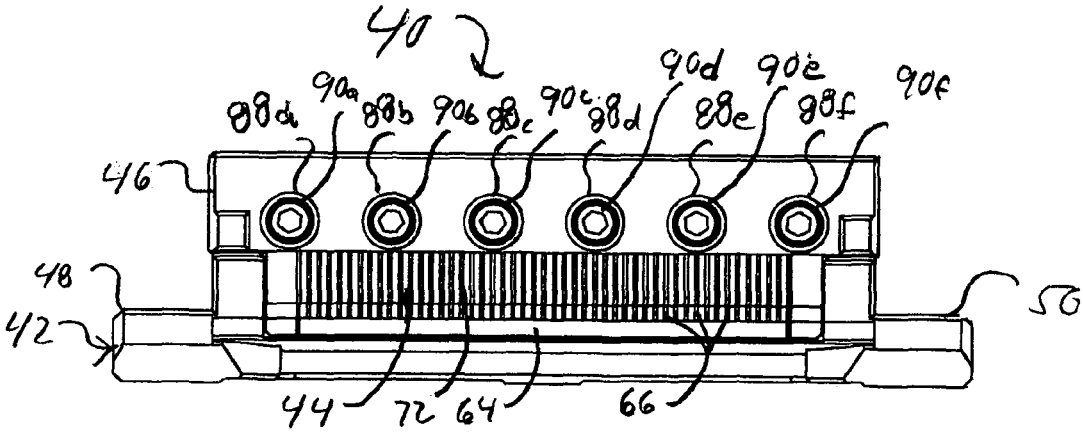
FIG. 7 is a front elevation view of the row tool in FIG. 4.
Figure 8:
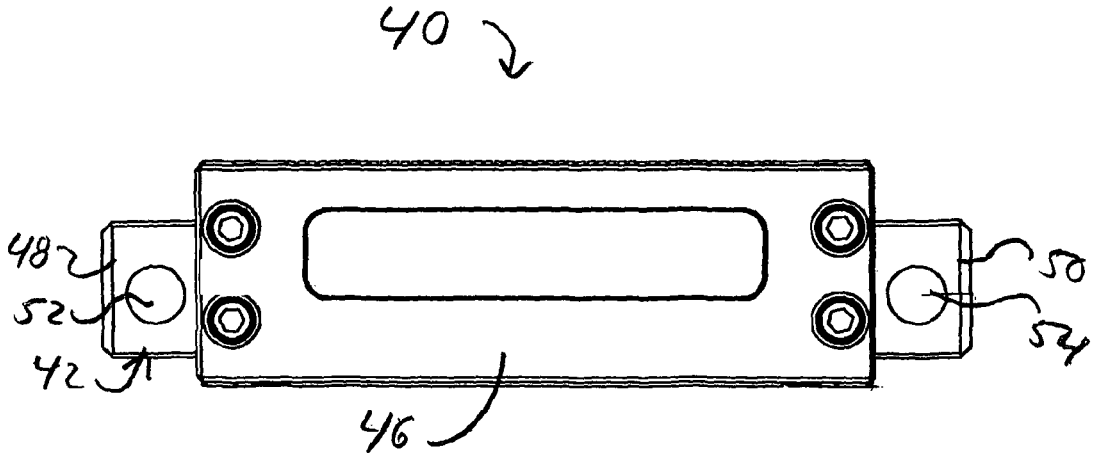
FIG. 8 is a top view of the row tool in FIG. 4.

The present invention provides row tools that can be used in magnetic head lapping machines to more efficiently lap rows of magnetic heads. The row tools include numerous bending/control nodes to control the heads such that the heads can be lapped using SLLT. In other embodiments of the row tool the bending nodes can be used to control more than one of the heads in a row during lapping. The row tool also proves an uninterrupted surface with the row of magnetic heads mounted to the surface for lapping. The uninterrupted surface allows the row to be lapped without the row flexing into the space between the bending nodes. The surface also allows the control force of the bending nodes to transfer through the bridge to the row during lapping. As a result, the bumps and imperfections associated with lapping using conventional row tools can be avoided. The arrangement provides the desired control over lapping of the heads in the row while reducing waste and providing heads having a higher quality.

Row tools according to the present invention comprise a bridge across the space between the bending nodes, with the bridge having a width sufficient to hold the row of magnetic heads, and a sufficient thickness to support the row under the force of lapping while still allowing for lapping control by the bending nodes. The bridge can be used in many different row tools and can be formed integral to the bending nodes or mounted to the bending nodes.

FIGS. 4-9 show one embodiment of a row tool 40 according to the present invention that can be mounted within a lapping machine for lapping a row of magnetic heads. The row tool 40 comprises three primary components including the base 42, bridge carrier 44, and clamp 46, all of which are arranged in the assembled row tool such that the bridge carrier 44 is held between the base 42 and clamp 46.

The base 42 provides the mounting points to a lapping machine, and many different mounting methods can be used that can be arranged in different locations on the base 42. In a preferred embodiment, the base 42 has first and second mounting tabs 48, 50 that extend from the ends of the base 42, with first and second mounting holes 52, 54 passing through. Mounting screws or bolts (not shown) pass through the mounting holes 52, 54 and into threading holes in the lapping machine to provide a strong and stable connection to the lapping machine so that the row tool 40 is held firmly in place during lapping of the row.

The base 42 also has a bridge carrier surface 55 (shown in FIG. 5) for the bridge carrier to rest in the assembled tool 40. As more fully described below, the bending nodes are arranged to move freely over the surface 55. Threaded base mounting holes 56*a-d* are provided to accept a screw or bolt for mounting the clamp 46 to the base 42. The base 42 can be made of many different rigid materials such as metals and ceramics, with a preferred material being stainless steel, such as commercially available 17-4 PH900 stainless steel. The base can be fabricated using known methods including but not limited to electro discharge machining (EDM).

The bridge carrier 44 comprises the bridge 64, along with bending nodes 66 that control the flexing of the bridge 64 during lapping. The bridge 64 provides an uninterrupted surface onto which row 57 (shown in FIG. 4) is bonded for lapping. Many different bonding methods and materials can be used that provide the necessary adhesive force during lapping and also allow for the row 57 to be easily removed from bridge 64 after lapping. A suitable bonding material is commercially available thermo-plastic adhesive that when heated releases the row from the bridge 64. Different adhesives can be used depending on the type of magnetic heads being lapped. The adhesive typically has a melting temperature of approximately 100° to release the row. The adhesive should also have minimal surface tension and uniform thickness under the row 57. In some embodiments the adhesive can be conductive by including conductive particles, such as silver particles.

Figure 9:
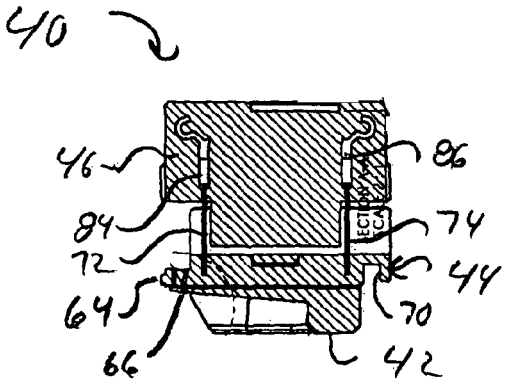
FIG. 9 is a sectional view of the row tool in FIG. 4 taken along section lines 9-9.

The bridge carrier 44 can have different numbers of bending nodes depending on the number of heads in the row that is being lapped and whether the row tool is providing SLLT, as described above. In the embodiment shown the bridge carrier 44 has forty-eight (48) bending nodes 66 each of which can be independently manipulated forward or back as shown by arrow 68. As best shown in FIG. 9 the bridge carrier has a series of hooks 70 on its lateral section 76, opposite the bridge 64, with each of the hooks 70 used by the lapping system to manipulate one of the bending nodes 66. For row tool 40 there are forty-eight hooks corresponding to the forty-eight bending nodes 66. The lapping machine has a series of controls that engage the hooks 70 when the row tool 40 is mounted to the lapping machine. The controls manipulate flexing of the bridge 64 by moving the particular ones of the bending nodes 66 back or forth to control lapping of the row.

The bridge carrier 44 also comprises first and second flexures 72, 74 that provide anchors for the bending nodes 66. As more fully described below, the flexures 72, 74 are firmly mounted to the clamp 46 so that the bending nodes 66 can move back and forth under control of the lapping machine, with the flexures 72, 74 causing the bending nodes to return to a neutral position when the force from the lapping machine controls is removed.

The bridge carrier 44 can be also be made of many different rigid materials such as a metal or ceramic, with the preferred material being 17-4 PH900 stainless steel. It can be fabricated using EDM and can be fabricated from a single piece of material or different pieces that are then assembled. One embodiment of a bridge carrier 44 is made of four different pieces each, of which can be fabricated using EDM or other methods, with the four pieces including the carrier lateral section 76, the first and second flexures 70, 72, and the stability bar 78. These pieces are then assembled and bonded together to form the bridge carrier 44.

In row tool 40 the bridge 64 is formed integral to the bending nodes 66 during fabrication of the lateral section 76. Alternatively, the bridge can be formed separately from the row tool and bonded to the bending nodes 66. In embodiments where the bridge 64 is separately manufactured, it can be made of the same or different material than the bending nodes 66. In one embodiment it can be made of ceramic material such as an aluminum oxide or yttrium doped zirconia, which can exhibit improved robustness and can include materials to provide for electro-static discharge (ESD) protection. Separately formed bridges can be mounted to the bending nodes using adhesives or by brazing.

The bridge 64 can have many different dimensions and should be long enough to run along and cover all of the bending nodes 66, and should be wide enough to hold the particular row of magnetic heads that is being lapped. The bridge 64 should also be thick enough so that it does not flex into the space between the bending nodes 66 during lapping and should be thin enough so that movement of the bending nodes is transferred through the bridge 64 to the row being lapped. In a preferred embodiment the bridge is approximately 0.0485 inches (±0.0005 inches) thick as measured where the bridge 64 spans one of the spaces between the bending nodes 66.

The row tool 40 also comprises a clamp 46 that is mounted to the base 42 with the bridge carrier 44 held between the base 42 and clamp 46. The clamp includes clamp mounting holes 80*a-d* that align with the base mounting holes 56*a-d* in the base 42. Assembly screws 82*a-d* are included that are sized to pass through the clamp mounting holes 80*a-d* and mate with the threads in the base mounting holes 56*a-d* to mount the clamp 46 to the base 42.

The clamp 46 further comprises first and second longitudinal slots 84, 86 that are sized to accept the bridge carrier's first and second flexures 72, 74 respectively. As best shown in FIG. 9, when the row tool 40 is assembled, the top portion of the flexures 72, 74 are inserted into the slots 84, 86 and remain in the slots in the finally assembled row tool 40. The clamp further comprises threaded first flexure holes 88*a-f* sized to mate with first flexure screws 90*a-f*, and threaded second flexure holes (not shown) on the opposite side of the clamp 46, sized to mate with second flexure screws 94*a-f*. Each of the first screws 90*a-f* turns into its respective one of the first flexure holes 88*a-f* to close the first slot 84 on the top portion of the first flexure 72. Second screws 94*a-f* similarly cooperate with second flexure holes to close the second slot 86 on the top portion of the second flexure 74. Different numbers of flexures screws can be used according to the present invention, with six being a suitable number to overcome the stiffness of the clamp 46 to reliably clamp the flexures 72, 74 in the slots 84, 86 such that the flexures 72, 74 are solidly held in place. This allows the flexure points 66 to be accurately controlled by the lapping machine as described above.

The clamp 46 can be made of the same rigid material and made using the same fabrication process as the base 42 and the bridge carrier 44. When assembled, a continuous lapping surface for a row is provided at the bridge 64 with the row tool 40 also providing an accurate and reliable mechanism for manipulating the surface of the bridge 64 during lapping.

Figure 10:
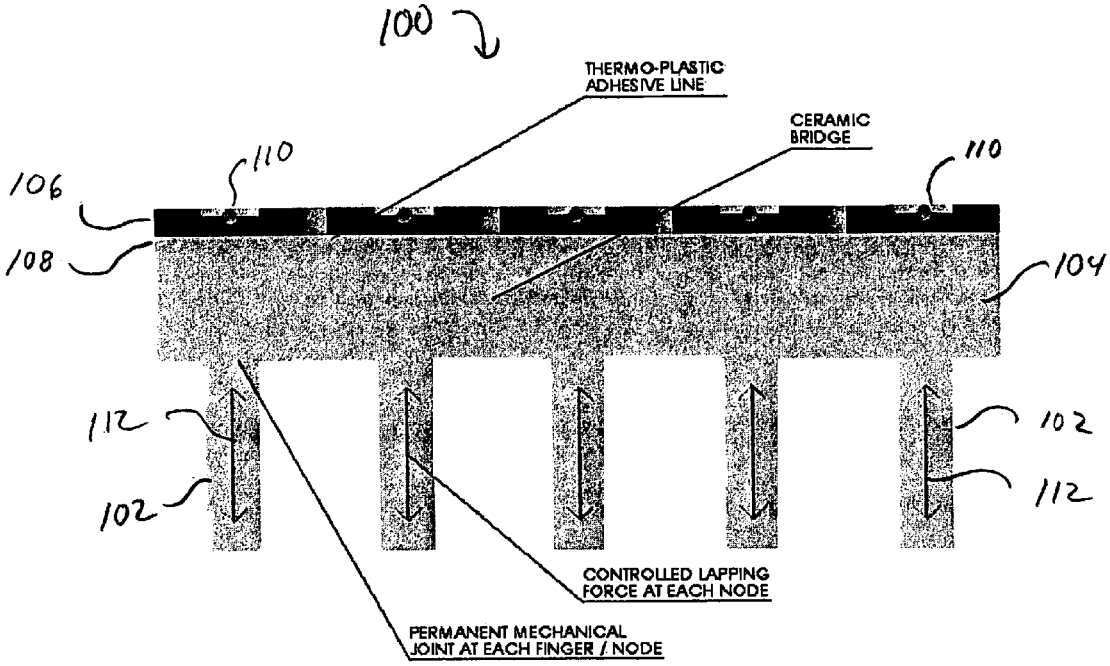
FIG. 10 is a sectional view of a row mounted to a row tool according to the present invention showing the bridge between bending nodes.

FIG. 10 shows the bridge and bending node arrangement from a row tool 100 according to the present invention. Tool 100 comprises bending nodes 102 with a bridge 104 integral with or mounted to the ends of the bending nodes 102. A row 106 is mounted to the bridge 104 preferably by a thermo plastic adhesive 108 as described above. The row 106 is positioned on a surface of bridge 104 with each individual magnetic head 110 in the row aligned with one of the bending nodes 102 pursuant to SLLT.

This arrangement allows the lapping of each of the heads to be controlled during lapping by the lapping machine individually manipulating the bending nodes 102 back and forth in the direction of arrows 112. This movement of bending nodes 102 causes movement of bridge 104, which in turn causes movement of row 106. This arrangement allows the lapping machine to control the shape of each head 110 in the row 106 during lapping, with bridge 104 preventing flexing of the row into the space between the bending nodes 102 that can result in bumps in row 106 after lapping.

Figure 11:
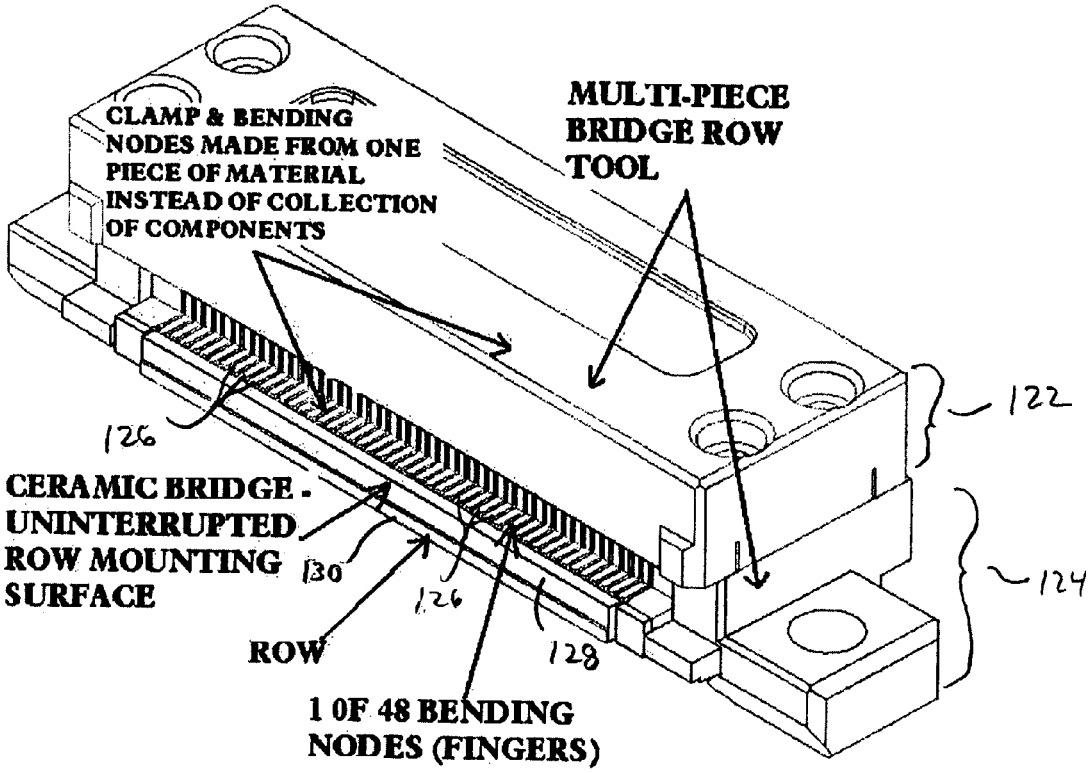
FIG. 11 is a perspective view of another embodiment of a row tool according to the present invention.

FIG. 11 shows another embodiment of a row tool 120 according with the present invention which includes an integrated assembly 122, formed of previously separate components, and a base assembly 124 that can be made of ceramic. It should be noted that row tool 120 is similar to row tool 40 discussed above in FIGS. 4-9, but has some differences in how the components are arranged. Like row tool 40, row tool 120 includes bending nodes 126 with a bridge 128 mounted across them. Row 130 can then be bonded to bridge 128, preferably by a thermo plastic adhesive as described above, with bridge 128 providing an uninterrupted surface between the nodes 126 and row 130.

Previous row tools arranged similar to tool 120 included separate subassemblies such as a clamp, bridge carrier, and base mounted together by screws. The clamp holds the bridge carrier and provides reference surfaces for the customer process tooling. The bridge carrier is arranged to allow the bending nodes 126 to move back and forth beneath the clamp subassembly under control of the lapping machine. The base serves as the mounting point to the lapping machine.

In conventional row tools these subassemblies are fabricated separately using conventional fabrication methods such as electro-discharge machining. Pursuant to the present invention, the clamp and bridge carrier can be fabricated as an integrated unit. Different fabrication methods can be used, with a preferred method using abrasive sawing technology or chemical etch machining, which are known in the art. The clamp and bridge carrier fabricated in the integrated assembly 122 can be made of many different materials, with a suitable material being a metal such as steel.

After integrated assembly 122 is typically formed having an insert assembly that is separated from the remainder of the integrated subassembly, with a preferred method being electro-discharge machining. By separating the insert subassembly, the bending nodes 126 in the final assembly are free to apply a force to bridge 128 and row 130 during lapping.

Base 124 can be made of many different materials, with a preferred material being ceramic. Integrated assembly 122 is mounted to base 124 with the bridge carrier properly mounted such that the bending nodes 126 can be manipulated during lapping. Bridge 128 can be made of many ridged materials, with a suitable material being ceramic. Another suitable material is ceramic which has certain desirable properties such as superior hardness and non-ductility.

By having portions of the tool 120 made of ceramics row 130 and its magnetic heads can be protected from electrostatic discharge (ESD). For ceramic bridges, the ceramic material can serve as an ESD buffer between bending nodes 126 and row 130 with the row 130 being protected from the conductive properties of the row tool components. This design can also improve the reliability and life of the row tool 120 due to the non-ductile properties of ceramic. By having an integrated assembly, row tool 120 also has fewer components to manufacture, which results in decreased manufacturing costs and improved manufacturability due to the inherent superiority of the abrasive sawing technology. Row tool 120 also does not need as many screws during assembly, reducing complexity of manufacturing and the danger of contamination in the lapping process. The ability to match a ceramic's physical properties to that of the row being lapped also can reduce in-process mechanical stresses in the row.

The ceramic bridge 128 can be brazed to the steel surface of bending nodes 126 with the brazing material at the surface of each of bending nodes 126 providing a mechanical connection to the two. In one embodiment, the ceramic bridge 128 is brazed to the steel surface of the bending nodes using a hard solder with a high melting point.

Figure 12:
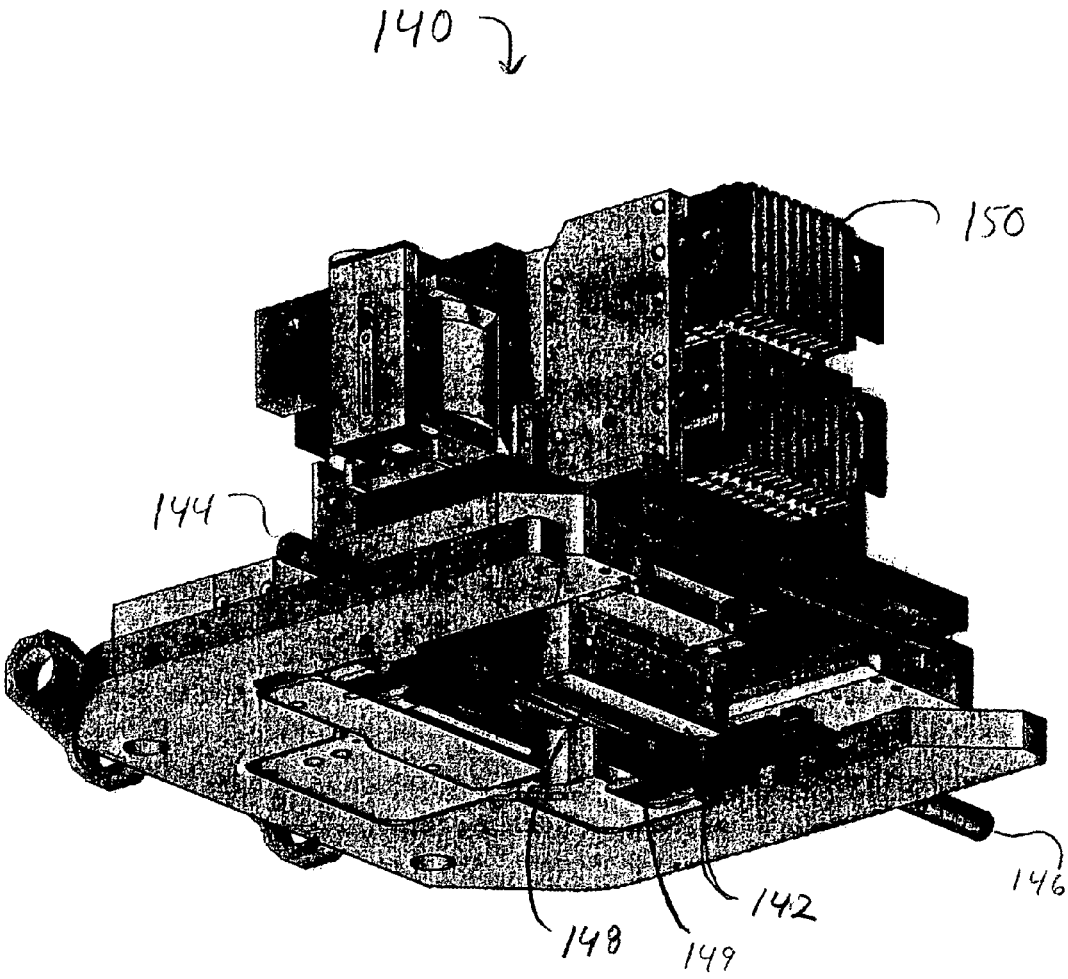
FIG. 12 is machine view of a lapping machine head using one embodiment of a row tool according to the present invention.

FIG. 12 shows a lapping machine control head 140 utilizing a row tool 142 according to the present invention. The control head 140 is mounted to a lapping machine at first and second mounting posts 144, 146 so that the control head is firmly held within the lapping machine. The row tool 142 is oriented in the control head so that the row 148 of magnetic heads is facing down. The row 148 is mounted to the row tool's bridge 149, pursuant to the present invention. The lapping surface in a typical lapping machine is facing up to engage the row 148 during lapping. The control head 140 further comprises a control voice coil 150 that is arranged to manipulate the row tool's bending node's during lapping by engaging the bending nodes at their hooks (shown above). The bending nodes are typically manipulated under control of the lapping machine which can comprise a data processor to determine the appropriate force to be applied by said bending nodes, and a system for generating commands to the control voice coil. In this way, the lapping of the individual heads in the row can be controlled during lapping.

Although the present invention has been described in considerable detail with reference to certain preferred configurations thereof, other versions are possible. Numerous modifications, variations and rearrangements can be readily envisioned to achieve substantially equivalent results, all of which are intended to be embraced within the spirit and scope of the invention as defined in the appended claims.

We claim:

1. A lapping row tool, comprising:

a plurality of bending nodes having a space between adjacent ones of said nodes and each of which has an end surface to manipulate a row of magnetic heads during lapping, said plurality of bending nodes spanning the entire length of said row of heads; and an uninterrupted bridge extending along the end surfaces of said bending nodes and across said space between said adjacent bending nodes, said bridge providing a surface for holding said row of magnetic heads and comprising a material that is stiff enough to prevent the flexing of said row into said space between said bending nodes during lapping while allowing said bending nodes to manipulate said row during lapping.

2. The tool of claim 1, wherein said bridge comprises a material which is flexible in response to a force applied by said bending nodes to said bridge.

3. The tool of claim 1, wherein the surface of said bridge holding said row of magnetic heads is substantially flat.

4. The tool of claim 1, further wherein each of said bending nodes can be individually manipulated during lapping of row held on said bridge surface.

5. The tool of claim 1, further wherein said row of magnetic heads is removably mounted to said bridge surface so that said row is firmly held to said surface during lapping and can be removed after lapping.

6. The tool of claim 1, wherein said row is mounted to said bridge surface by thermo plastic adhesive between said row and bridge surface.

7. The tool of claim 6, wherein said adhesive has substantially uniform thickness between said row and bridge surface.

8. The tool of claim 6, wherein said adhesive can be conductive.

9. The tool of claim 1, wherein portions can be made of a metal or ceramic.

10. A lapping row tool, compromising:

a plurality of bending nodes to manipulate a row of magnetic heads during lapping, said plurality of bending nodes spanning the entire length of said row of heads;

an uninterrupted surface holding said row of magnetic heads and comprising a material that is stiff enough to prevent the flexing of said row into the spaces between said bending nodes, while allowing said bending nodes to engage said uninterrupted surface and manipulate said magnetic heads during lapping by applying a force to said uninterrupted surface to alter the orientation of said surface and in turn, said row.

11. The tool of claim 10 wherein each of said bending nodes has an end portion, said uninterrupted surface engaged by said end portions of said bending nodes and altered under a force from the said ends.

12. The tool of claim 10, wherein said uninterrupted surface is alterable to adjust the shape of said row of magnetic heads during lapping.

13. The tool of claim 10, wherein said bending nodes are arranged adjacent to one another with a space between adjacent ones, said uninterrupted surface comprising a bridge along the ends of said bending nodes and across said space between adjacent bending nodes.

14. The tool of claim 13, wherein said bridge includes a material which is flexible in response to a force applied by said bending nodes during lapping.

15. The tool of claim 13, wherein said bridge prevents the flexing of said row into said space between said bending nodes during lapping.

16. The tool of claim 10, wherein said bending nodes are arranged adjacent to one another with a space between adjacent ones, said uninterrupted surface comprising the ends of said bending nodes and sections of material spanning said space between said bending nodes, at the end of said bending nodes.

17. The tool of claim 16, wherein said sections of material are flexible in response to a force applied by said bending nodes during lapping.

18. The tool of claim 16 wherein said sections of material prevent flexing of said row into said space between said bending nodes during lapping.

19. The tool of claim 10, wherein each of said bending nodes can be individually manipulated during lapping.

20. A lapping system control head, comprising:

a mounting post for mounting into a lapping machine;

a row tool mounted within said control head, said row tool including a plurality of bending nodes with an uninterrupted bridge on said bending nodes providing a surface for holding a row of magnetic heads, said plurality of bending nodes spanning the entire length of said row of heads, said bridge comprising a material that is stiff enough to prevent said bridge from flexing into the spaces between said bending nodes; and a control voice coil for manipulating said bending nodes, said bending nodes engaging said bridge to manipulate the shape of the surface of said bridge and in turn the shape of the row on said surface, to control lapping of the heads in said row.

21. The control head of claim 20, wherein each of said bending nodes further comprises a hook, said control voice coil engaging said hooks to manipulate said bending nodes.

22. The control head of claim 20, further comprising a system for generating command signals to said control voice coil such that said coil manipulates said bending nodes in response to said command signals.

23. The control head of 20, wherein said bridge comprises a material that is flexible enough so that the force of said bending nodes bends said bridge.

24. The tool of claim 1, wherein said bridge is formed integral to said bending.

25. The tool of claim 1, wherein each bending node can be individually manipulated to apply a force to said bridge.

* * * * *